US005295558A

United States Patent [19]

Cooperman

[11] Patent Number: 5,295,558

[45] Date of Patent: Mar. 22, 1994

[54] SCAFFOLD PLATFORM BRACE

[76] Inventor: Stephen M. Cooperman, P.O. Box 617, Stockbridge, Mass. 01262

[21] Appl. No.: 922,509

[22] Filed: Jul. 31, 1992

[51] Int. Cl.[5] ..... E04G 5/00

[52] U.S. Cl. ..... 182/222

[58] Field of Search ..... 182/222, 223, 119; 52/639, 643

[56] References Cited

U.S. PATENT DOCUMENTS 1,155,716 10/1915 Fest ..... 52/639 X 2,415,461 2/1947 Causey ..... 182/222

2,577,581 12/1951 Hammitt et al. ..... 52/639

2,726,123 12/1955 Mathews ..... 182/222 X 2,808,296 10/1957 Stinson ..... 182/222

*Primary Examiner*—Alvin C. Chin-Shue

[57] ABSTRACT

The invention is a truss assembly for each plank in a scaffold platorm. It consists of a triangular center pedestal, two tension straps, a tension bar mounting plate on the pedestal and necessary bolts and nuts to secure the assembly to the underside of each plank.

2 Claims, 2 Drawing Sheets

SCAFFOLD PLATFORM BRACE

FIELD OF INVENTION

This invention is in the field of construction and particularly for use with scaffolds. There are two types of scaffolds which can be used in construction work. One type is the free standing rectilinear frame comprising four upright members with two vertically spaced horizontal members between each pair of vertical members to make the frame rigid. The frame may be four feet square or four by six feet. This type of frame is most useful in construction of building walls since there is no weight or tipping movement placed on the walls. The frame is also useful when performing overhead work. The other type of scaffolding is an L-shaped bracket which is secured to walls by bolts or the like. With either frame or bracket, a platform is required and is made up of wooden planks laid side by side in the nominal size of 2×8-2×10-2×12 and in lengths from 8 to 16 feet. Despite the thickness of the planks any length greater than 6 feet deflects when walked on creating a possible hazard, particularly in longer lengths when the deflection can develop a harmonic pattern. Thus, it is preferable to space the frames or brackets about 4–5 feet apart which increase the number of frames or brackets required and is an expense to the builder. The alternative to such numbers would be to use 3 inch planks but those are heavy and not easily moved by workmen.

SUMMARY OF THE INVENTION

The invention is a truss assembly for each plank in a scaffold platorm. It consists of a triangular center pedestal, two tension straps, a tension bar mounting plate on the pedestal and necessary bolts and nuts to secure the assembly to the underside of each plank.

BRIEF DESCRIPTION OF THE DRAWINGS

The invention can be seen in the accompanying drawings which illustrate a currently preferred embodiment.

DETAILED DESCRIPTION OF THE INVENTION

Figures 1, 5, 6:
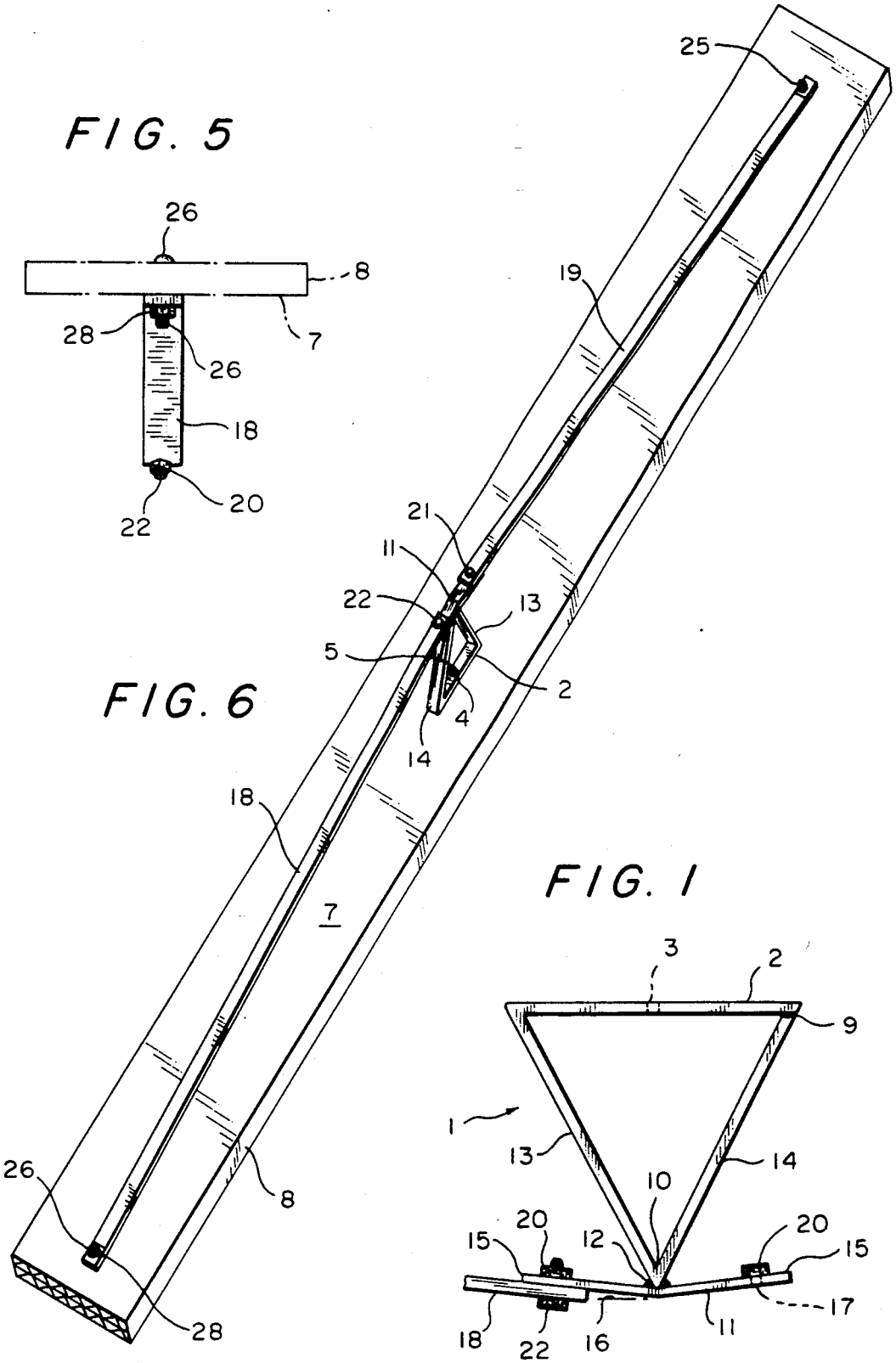
FIG. 1 is an elevation view of one side of the support pedestal of the invention when in the operative position, the view of the opposite side being identical.
FIG. 5 is a end view of the assembly installed on a footwalk plank.
FIG. 6 is an isometric view of the installation of the invention on the underside of a footwalk plank.
Figure 3:
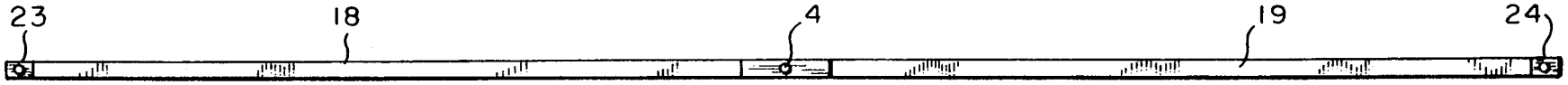
FIG. 3 is a top plan view of FIG. 2.
Figure 4:
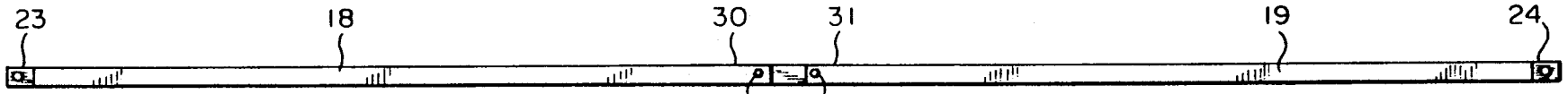
FIG. 4 is a bottom plan view of FIG. 2.
Figure 2:
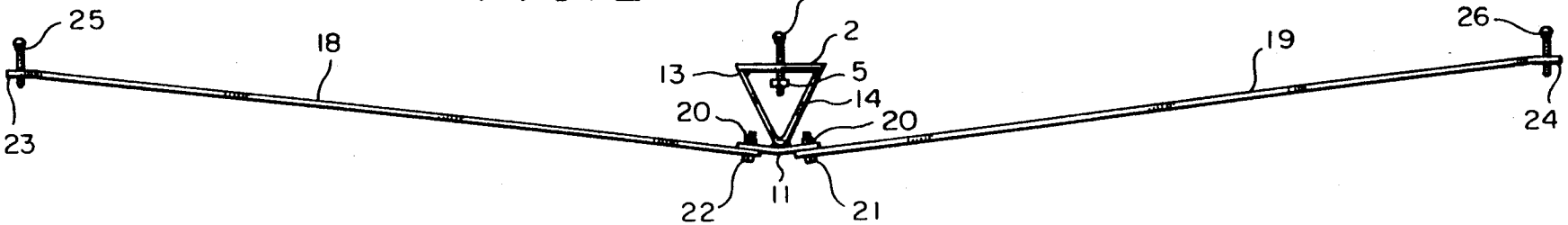
FIG. 2 is an elevation view of one side of the entire assembly in the operative position, the view of the opposite side being identical.

The principal element in the invention is the triangular central pedestal 1. As can be seen it is an isoceles triangle with an altitude substantially equal to its base length. All parts of the assembly are formed from ¼ inch by 1 inch bar steel. The mounting base 2 has an opening 3 to receive a bolt 4 which together with a nut 5 secures the base 2 to the undersurface 7 of a plank 8. The triangular shape is formed by conventional metal working procedures and the ends of the triangle are joined by weld 9. At the apex 10 a tension strap mounting plate 11 is welded 12 to each side 13 and 14 of the triangle apex. As seen in FIG. 1, the plate 11 has its end portions 15 angled upwardly as seen at 16. For the embodiment described herein, the angle 16 is 7°. Each end portion of plate 11 has an opening 17 to receive a bolt to secure one end of each tension strap 18 and 19 to the plate. As will be noted, a nut 20 for bolts 21 and 22 is positioned over each opening 17 and welded to said plate 11. This arrangement not only facilitates assembly but prevents loss of or misplacing the nut. One end portion 23 and 24 of each tension strap 18 and 19 is deformed at an angle which will place that end portion in surface to surface contact with the undersurface 7 of plank 8. An opening (not shown) in each such end portion receives a carriage bolt 25 and 26 which has been passed through plank 8 and is secured therein by a nut 29 and 28. The opposite end 30 and 31 of each tension strap remains undeformed and has an opening (not visible) through which a bolt 20 or 21 can be passed to secure that end portion to the respective end portion of tension strap mounting plate 11 by engaging with the respective fixed nut 20. The assembled truss in the operative position is clearly shown in FIG. 6.

In the particular embodiment shown and described herein, the truss parameters are as follows: the pedestal has a base length of 6½ inches and an altitude of 6½ inches; each tension strap is 5 feet in length; and the carriage bolts 25/26 are preferably at least ½ inch by 4 inches to protrude below nuts 27/28. The above parameters are suitable for use with plank lengths of 10 to 16 feet. For planks in the 18 to 24 foot range, tension straps would be appropriately lengthened.

What is claimed is:

1. A brace for each plank in a scaffold platform, which brace is mounted on each plank undersurface, comprising a central pedestal with an opening to attach said pedestal to said plank undersurface, a pair of opposing tension straps, each said strap having an opening in each end thereof, a tension strap mounting plate having end portions and secured to one end of said pedestal, said plate end portions each having an opening therethrough to receive a bolt to secure one end of each strap to the respective plate end portions, said plate end portions further having a nut for said bolt welded to said end portion inner surface about said plate opening, each said strap opposite end portion being deformed to seat said end portion into surface to surface contact with said plank undersurface and means to pass through said openings to secure said brace to said plank.

2. The brace according to claim 1, wherein said pedestal is an isoceles triangle having a base length and altitude substantially identical, said base length being attached to said undersurface with triangle apex depending from said base and said mounting strap is secured to said apex, the end portions of said plate being upwardly deformed.

* * * * *